United States Patent [19]

Sherwood

[11] 4,325,245

[45] Apr. 20, 1982

[54] ROLLING MILL STAND

[76] Inventor: William L. Sherwood, 6968 Ash St., Vancouver, British Columbia, Canada

[21] Appl. No.: 130,063

[22] Filed: Mar. 13, 1980

[51] Int. Cl.[3] ..... B21B 31/24

[52] U.S. Cl. ..... 72/248; 72/244

[58] Field of Search ..... 72/237, 244, 248, 249

[56] References Cited

U.S. PATENT DOCUMENTS

| | | | |
|---|---|---|---|
| Re. 28,107 | 8/1974 | Wilson et al. | 72/235 |
| 3,348,403 | 10/1967 | Bartley | 72/237 |
| 3,468,151 | 9/1969 | Diolot | 72/245 X |
| 3,610,014 | 10/1971 | Weber | 72/244 |
| 4,132,099 | 1/1979 | Elsener | 72/249 X |

*Primary Examiner*—Leon Gilden

[57] ABSTRACT

A clamshell-type rolling mill stand is provided with separate top and bottom housing boxes each carrying a cantilevered work roll. The rolls are in the form of roll rings mounted on the front extension of a main shaft carried in a main load bearing in the front wall and a reaction load bearing in the back wall of the housing box. Each housing box contains a drive gear integral with the main shaft which is driven by a plurality of planetary pinions. Each pinion shaft projects through the box back wall where it is coupled to a drive motor, usually hydraulic, fixed to a bracket also mounted on the box to move with it. A fixed pass line is maintained by means of a symmetrical adjustment of the top and bottom housing boxes on either side of the pass line. This is accomplished by eccentric bushings on a shaft through each box, the shafts being rotatable but held at a constant distance from each other by spacer-supports which are free to move in the rolling direction but are restrained from movement in the pass line direction facilitating guide positioning and tracking of the stock during rolling.

4 Claims, 6 Drawing Figures

ROLLING MILL STAND

The invention relates to metal rolling mills, and more particularly, to an improved rolling mill stand with cantilevered work rolls.

Rolling mill stands with cantilevered rolls generally comprise a single housing box through which both shafts are projected, having changeable roll rings mounted on the projecting shaft ends. Such stands have become the common standard for high-speed finishing blocks for wire rod, and have also found increasing application as rougher, intermediate and finishing stands in continuous mills producing hot-rolled bars.

In these stands, the roll parting is adjusted by means of rotatable eccentric bushings mounted around the main roll shafts themselves, or other mechanical or hydraulic mechanisms acting upon the shafts. Disadvantages include limited and often inadequate range of adjustment, roll movement in the rolling direction, and thereby relative to the guides, during adjustment, and necessity for a mechanical arrangement to maintain and synchronize the drive train during the relative movement of the shafts.

There have been some suggested designs and actual application of 'clamshell' type stands having separate top and bottom housing boxes hinged on one side of the roll pair with hydraulic, eccentric or other adjustment means on the other side, but these generally lack the facility to maintain a fixed position pass line during the adjustment, or are complex and costly in arrangement.

Hydraulic drive motors offer several advantages for rolling mill stands, such as high torque-to-size ratio, low inertia facilitating speed change/reversal, and infinitely variable speed at low cost for control. The advantages are particularly evident when low-speed high-torque characteristics enable the elimination of costly reduction gear-boxes. A reason that they have not found general application in billet, bar and rod mill stand drives is because the range of combinations of torque-speed-physical size available in commercially available hydraulic motors admits only a limited number of rolling stand situations. Often, a single hydraulic drive motor or even a pair of motors offer inadequate torque, inadequate power, or both, for direct drive of a pinion stand input shaft. If two hydraulic motors are mounted on the roll shafts, the motor size necessary to meet torque requirements may also be physically too large to fit in between the required roll centres.

An object of the present invention is to provide a simple, low-cost means for obtaining a wide adjustment range for adjusting the roll parting and centre-to-centre distance between top and bottom rolls, at the same time maintaining a fixed pass line in the vertical direction and negligibly small movement in the rolling direction across the range of adjustment. This largely eliminates the requirement for guide repositioning in either the vertical or pass-line directions when roll changes or adjustments to roll parting are made, and also enables a level pass line to be maintained between roll stands, and between stands and tables, despite changes in roll diameter and roll parting.

Another object is provision of means for mounting of multiple drive motors, particularly hydraulic drive motors with controlled variable speed, directly on the stand housings, eliminating the necessity in many cases for both a pinion stand with spindles and couplings, and also separate gear reducer. This provides configurations covering a much broader range of speeds and torques without resorting to complex drive trains comparatively much higher in cost.

The invention provides a clamshell-type rolling mill stand with cantilevered work rolls, featuring a top housing box and a bottom housing box, which are generally connected together by hinges on either the entry or exit side of the stand, with the hinges supported from the stand base or other fixed support. On the non-hinged side, each box is equipped with rotatable eccentric bushings mounted on a parting shaft member with axis parallel to the hinge axis and riding in circular bearing surfaces in the front and back walls of the housing box. The top and bottom parting shafts are connected together by spacer plates which allow shaft rotation. The spacer plates, in turn, are supported from the rolling stand base on linear bearings with direction of travel parallel to the rolling direction. By employing a worm gear arrangement or other mechanical means to rotate the top and bottom parting shafts equally in opposite directions, the clamshells i.e. the top and bottom housing boxes, are opened and shut symmetrically on either side of the pass line. The horizontal motion caused by rotation of the eccentrics is thus reflected by movement of the support-spacer plates on the linear bearings, rather than by displacement of the housing or roll shafts in the pass-line direction.

Each housing box is enclosed and consists of a heavy plate front wall carrying a main load bearing and a rear wall carrying a reaction load bearing designed as necessary to carry the roll separating force without excessive deflection or distortion. The housing boxes are enclosed by lighter side, bottom and top walls connecting between the front and back load-bearing walls, and arranged to carry a sealed-in lubricant bath. The rolls are in the form of work roll rings mounted on the front extension of the main shaft which rides in the main and reaction load bearings and is equipped with a spur or helical gear within the housing box. This gear is driven by planetary pinions mounted on parallel pinion shafts which project from the back wall of the housing box. These shafts, in turn, are coupled to variable speed hydraulic drive motors mounted on brackets which are attached to and integral with the housing box. By thus employing multiple drive motors and pinions in planetary configuration, the total stand torque and power are proportionally increased, with little or no increase in necessary size of the main drive gears.

The above arrangement provides a full 180° rotation of the eccentric roll parting adjustment, yielding the maximum possible range of adjustment for a given amount of eccentricity. Roll shaft eccentric mechanisms are most often limited to smaller angles of rotation. For roll parting maintenance and adjustment, large hydraulic cylinders, complicated hydraulic balancing systems and large eccentrics are not employed, even on the larger mill stands, thereby realizing significantly lower costs than many arrangements.

Various other objects, features and advantages of the method and apparatus of this invention will become apparent from the following detailed description and claims, and by referring to the accompanying drawings.

Figure 1:
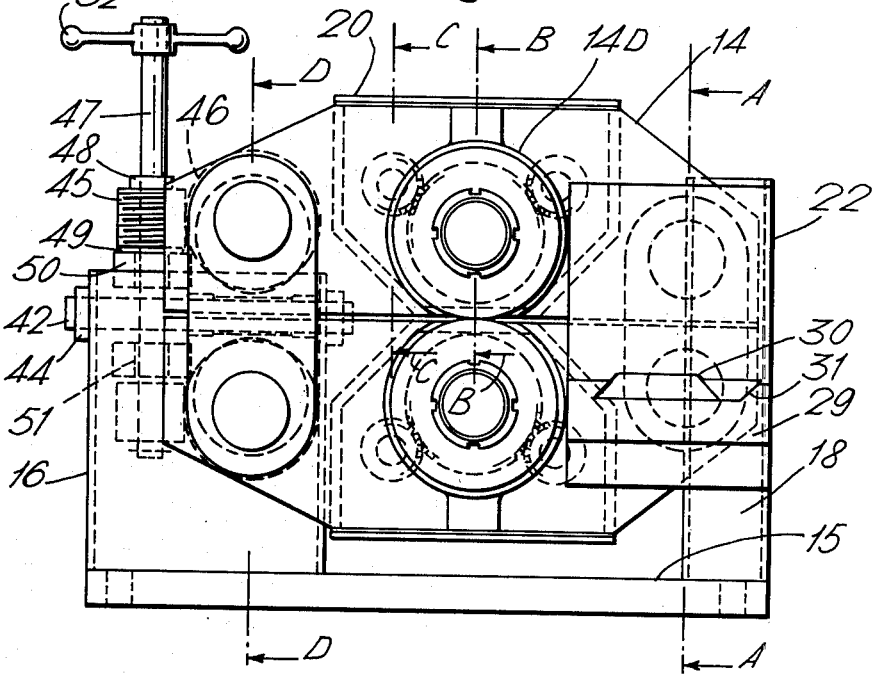
FIG. 1 is a front elevation view of a typical rolling mill stand according to the present invention.
Figure 3:
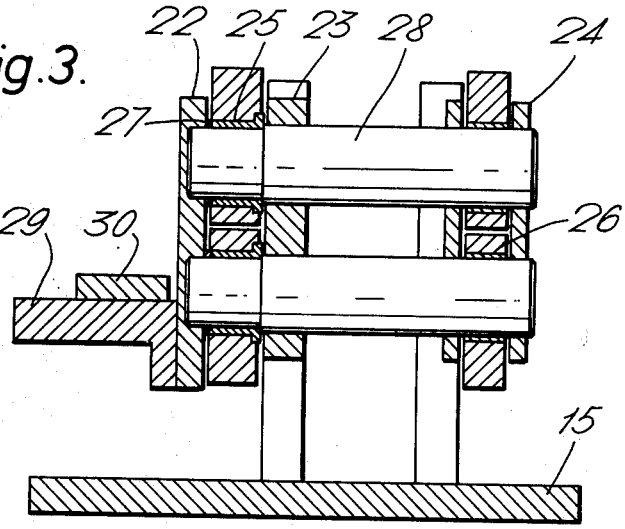
FIG. 3 is a sectional view along plane A—A of FIG. 1.
Figure 2:
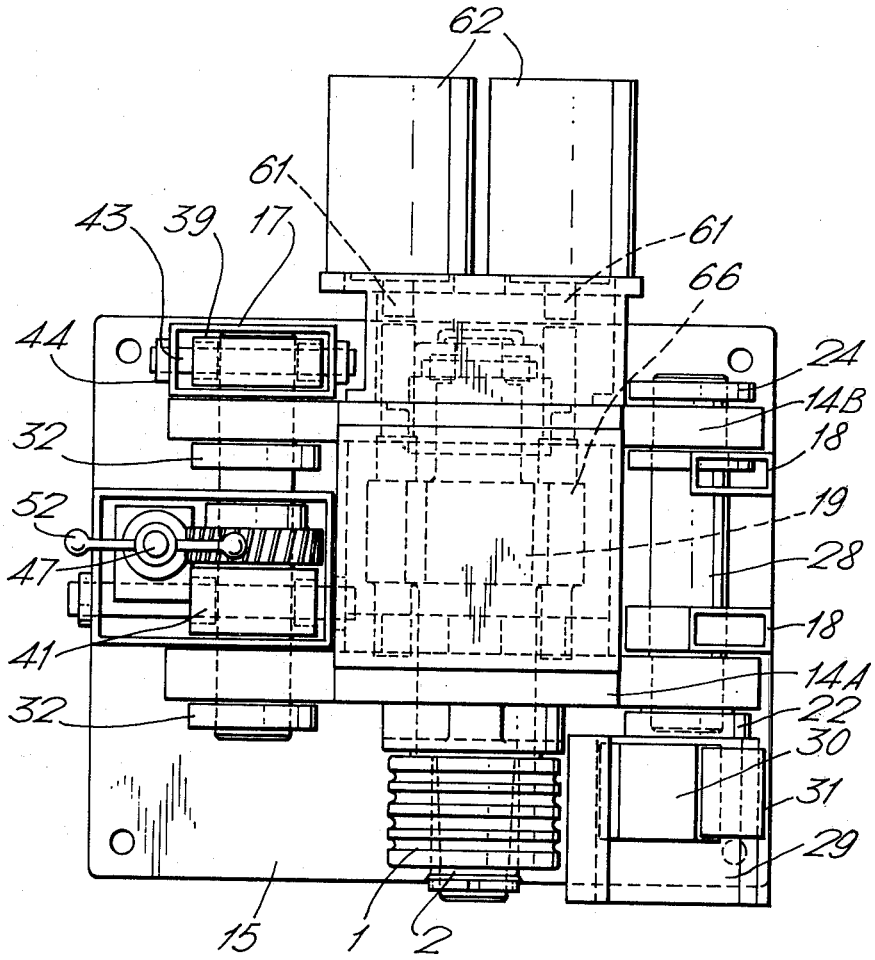
FIG. 2 is a corresponding plan view of the rolling mill stand.
Figure 4:
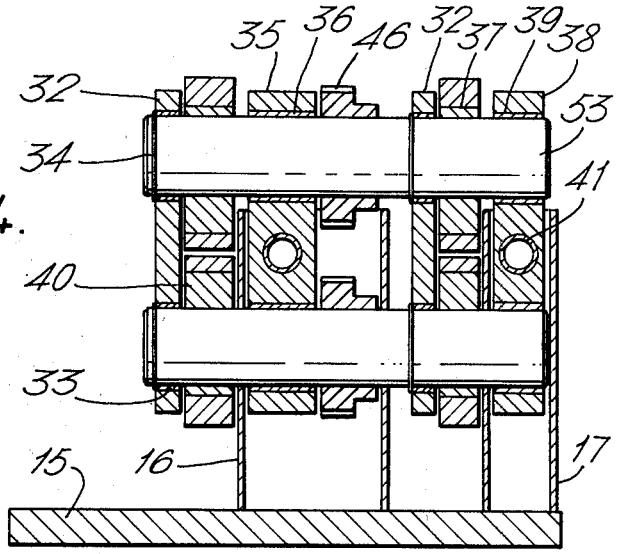
FIG. 4 is a sectional view along plane D—D, of FIG. 1.
Figure 5:
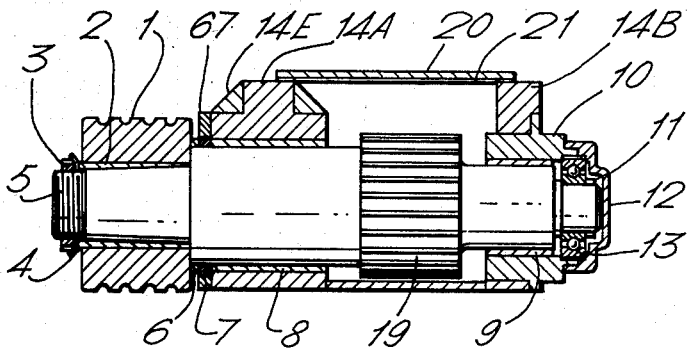
FIG. 5 is a sectional view along plane B—B of FIG. 1.
Figure 6:
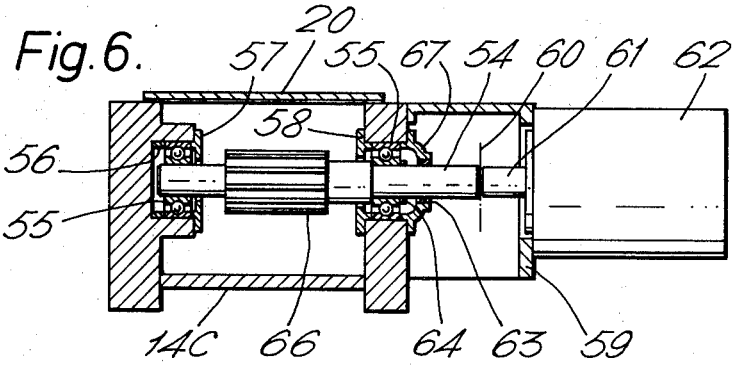
FIG. 6 is a sectional view along plane C—C of FIG. 1.

Referring to the drawings, the top and bottom main roll shafts 5 are each mounted within separate top roll and bottom roll housing boxes 14, hinged around fixed hinge pin shafts 28 on the entry side of the stand, for adjustable opening and closing of parting adjustment shafts 53 on the exit side of the mill, in a clamshell-type configuration. The housing boxes 14 comprise a heavy front plate 14A suitable to take up the main bearing load, a back plate 14B and bottom and side enclosure plates 14C. Each box includes a removable cover plate 20 sealed by gasket 21 to provide access to the box interior.

The hinge pin shafts 28 are held in place by vertical hinge posts 18 resting on base plate 15. In the embodiment illustrated, the shafts 28 are welded to the posts 18, and the top and bottom hinge pin housing bushings 25, 26 are allowed to rotate about the shafts 28. The roll force is taken by spacer plates 22, 23, 24 also fixed and connecting between top and bottom hinge pin shafts 28. The relative axial position of top and bottom housing boxes is adjusted and maintained by hinge pin spacer washers 27 in combination with the thrust faces of the bushings. Among alternative embodiments would be a single hinge pin acting with interleaved housing box plates.

The parting adjustment shafts 53, on the other hand, are mounted to allow rotation and equipped with eccentric bushings 40, 37 fixed on the shafts to rotate within circular bearing holes in the housing box plates. The parting adjustment shafts 53 also rotate within bushings 33, 36, 39 or spacer plates 32, and spacer-support plates 35, 38, which take up the roll force. Spacer plates 32 are held in place by retaining snap rings 34. In order to maintain a fixed pass line between the rolls at various values of roll parting and roll diameter, as effected by eccentric rotation, it is necessary to fix the position of spacer-support plates 35, 38 vertically, at the same time allowing horizontal movement parallel to the pass line.

In the embodiment illustrated, this is accomplished by the supporting horizontal guide rods 42 and 43, which are fastened with collars 44, upon support posts 16, 17 fixed to base plate 15, in orientation parallel to the pass line, and passing through linear spacer-support guide bushings 39, 41. This allows the entire roll parting adjustment assembly to move freely in the pass-line direction, but maintains its vertical position fixed.

To obtain equal housing separation on either side of the pass line, the top and bottom shafts must rotate equally but in opposite directions. Right handed and left handed worms 45, drive worm gears 46 on shafts 53, and are mounted on vertical worm shaft 47 which is supported within worm shaft bushings 51 and thrust washers 49 which, in turn, are integral with worm shaft brackets 50 attached to spacer-support 35. The worm shaft 47 is held in place by collars 48 and the housing box separation, and hence the roll parting, is adjusted by rotating handwheel 52 when the mill is not under load.

Roll ring 1, in which the roll passes are cut, is mounted on internally tapered bushing 2, preferably employing the oil injection method, locked on the main roll shaft 5 mandrel by locknut 3 and lockwasher 4. The main shaft rotates within radial main load bearing 8 held in cylindrical support sleeve 14D which forms part of front plate 14A of the housing box and within reaction load bearing 9 in the back wall, with axial position and thrust load being taken by thrust bearings 13 held in place by locknuts 11. Gussets 14E act as stiffeners for sleeve 14D. The rear bearing 9 is contained in a removable bearing support sleeve 10, which includes a cover plate 12, to allow for convenient insertion and removal of the main gear 19 outside diameter. The two main gears 19 are rotated by planetary drive pinions 66, with two drive pinion shafts 54 for each housing, or four in total for the mill stand illustrated. The drive pinion shafts 54 rotate within bearings 55 including appropriate cover plates 57, 58, 67, spacers 56 and locknuts 64. Each pinion shaft is rotated by an individual hydraulic motor 62, mounted on housing bracket 59, and is connected to the drive pinion shaft 54 by a coupling 60. The housing box incorporates main shaft oil seals 7, water-mill scale exclusion seal 6 and pinion shaft oil seals 63. The box is covered with a removable gasketed cover plate 20, 21 to provide access. All bearings are supplied with oil under pressure and a recirculation system can be employed according to known practice.

The front hinge pin spacer plate 22 is of large size to facilitate mounting of a rest bar 29 suitable for a guide box dovetail support 30 and locknut 31. The exit side rest bar and guide box is most appropriately supported on a base mounted pedestal (not illustrated).

The fluid supply to the hydraulic motors on each housing box are connected in parallel providing for natural sychronization. The apportionment of fluid to top and bottom boxes can be regulated in known manner by flow control valves, hydraulic flow dividers or, at an increased cost, feedback control regulation via variable output pumps or flow control valves.

It will also be evident that, rather than the internal gears 5 and pinions the main shaft could be driven through external spindles and couplings from a pinion stand in common manner. Also, rather than a clamshell stand with a hinge on one side and roll parting adjustment assembly on the other side, as described, both sides could comprise a parting assembly.

Further, the stand need not necessarily include the planetary drive arrangement. Omitting the gear and pinions inside the housing box, the main shaft extension could be fitted with wabbler or like coupling means to drive spindles, pinion stand and drive according to conventional practice.

It will also be evident that the stand assembly could be mounted vertically, or at an angle, rather than horizontally as shown. In the foregoing description and claims, 'horizontal' therefore means parallel to the stand base, and 'vertical' means perpendicular to it.

It will be appreciated that a preferred embodiment of an improved rolling mill stand has been described and illustrated and that variations and modifications may be made by persons skilled in the art, without departing from the scope of the invention defined in the appended claims.

I claim:

1. In a rolling mill stand employing cantilevered work rolls, the combination comprising a top roll housing box and a bottom roll housing box mounted one above the other, a roll shaft supported for rotation within a main load bearing mounted in the back wall, said shaft projecting from the housing box front wall and carrying a work roll ring mounted on the projecting shaft end; at least one pair of parting adjustment shaft members, a top shaft in the top bearing box, and a bottom shaft in the bottom bearing box, with axes oriented horizontally, parallel and in a plane substantially at right angles to the pass line on which are fixed external circular eccentric bushings for rotation with the shafts and within bearing surfaces in said front and back walls of said housing boxes; at least one spacer member connecting between said top and bottom shafts adapted for maintaining fixed spacing between the shafts while allowing for shaft and bushing rotation; a fixed support for maintaining a constant vertical position of said spacer member; a sliding guide integral with said fixed support allowing horizontal movement of the said spacer member and thereby of said shafts in the rolling pass-line direction; rotation means for rotating the top parting shaft and bottom parting shaft simultaneously in opposite directions, for substantial equal angular distances, thereby adjusting the spacing between the top and bottom housing boxes according to the amount and direction of eccentricity of said circular bushings.

2. A rolling mill stand according to claim 1 wherein said rotation means comprises a worm gear mounted on each parting shaft member, a common vertical worm shaft with opposite hand but otherwise substantially identical worms mounted on said spacer member and engaging said worm gears thereby securing equal and opposite rotation of said shafts and eccentric bushings as the vertical shaft is rotated.

3. A rolling mill stand according to claim 2 wherein said worm shaft is equipped with a handwheel for manual rotation to adjust the roll parting.

4. A rolling mill stand according to claim 1 in the form of a clamshell-type stand arrangement wherein said housing boxes are linked by fixed position hinges on one side of the roll shafts about which said boxes are rotatable, and on the other side of the roll shafts are located one pair of said parting shaft members and related assembly for adjusting the opening between said top and bottom housing boxes symmetrically on either side of the pass line.

* * * * *

UNITED STATES PATENT AND TRADEMARK OFFICE

CERTIFICATE OF CORRECTION

PATENT NO. : 4,325,245

DATED : April 20, 1982

INVENTOR(S) : William L. Sherwood

It is certified that error appears in the above-identified patent and that said Letters Patent is hereby corrected as shown below:

Column 4, line 65, after "mounted" should be --in the front wall of each of said housing boxes and a reaction load bearing mounted--.

Signed and Sealed this

*Twentieth* Day of *March 1984*

[SEAL]

*Attest:*

GERALD J. MOSSINGHOFF

*Attesting Officer*

*Commissioner of Patents and Trademarks*